US005842647A

United States Patent [19]

Yoshizu et al.

[11] Patent Number: 5,842,647

[45] Date of Patent: Dec. 1, 1998

[54] FUEL INJECTION NOZZLE

[75] Inventors: Fumitsugu Yoshizu; Koji Kugimiya; Hiroaki Nozaki, all of Saitama-ken, Japan

[73] Assignee: Zexel Corporation, Tokyo, Japan

[21] Appl. No.: 749,782

[22] Filed: Nov. 15, 1996

[30] Foreign Application Priority Data

Dec. 1, 1995 [JP] Japan ..... 7-337781

[51] Int. Cl.[6] ..... F02M 61/06

[52] U.S. Cl. ..... 239/533.4; 73/700

[58] Field of Search ..... 239/533.3, 533.8, 239/533.4, 96, 5, 600

[56] References Cited

U.S. PATENT DOCUMENTS

| | | | |
|---|---|---|---|
| 2,274,215 | 2/1942 | Amery | 239/533.8 X |
| 3,633,823 | 1/1972 | Steiger | 239/533.8 X |
| 4,684,067 | 8/1987 | Cotter et al. | 239/533.8 X |

FOREIGN PATENT DOCUMENTS

| | | | |
|---|---|---|---|
| 397106 | 11/1990 | European Pat. Off. | 239/533.8 |
| 7-16041 | 4/1995 | Japan . | |

*Primary Examiner*—Kevin Weldon

[57] ABSTRACT

A dodge plunger, a nozzle spring, and a needle valve are received in a main body of a fuel injection nozzle in this order forwardly. The first fuel passage and the second fuel passage are formed in the main body. A distal end of the first fuel passage faces the needle valve, and a basal end thereof is open to a basal end face of the main body. A distal end of the second fuel passage faces the dodge plunger, and a basal end thereof is open to the basal end face of the main body. The basal ends of the first and second fuel passages are away from and independent of each other on the basal end face of the main body. A plug is attached to the basal end of the main body. A third fuel passage is formed in this plug. A distal end of the third fuel passage is in communication with the basal ends of the first and second fuel passages. The basal ends of the first and second fuel passages are in communication with each other only through the distal end of the third fuel passage.

5 Claims, 3 Drawing Sheets

FUEL INJECTION NOZZLE

BACKGROUND OF THE INVENTION

This invention relates to a fuel injection nozzle for injecting a fuel in two stages, namely, a pilot injection stage and a main injection stage.

Recently, in order to improve combustion efficiency, various types of fuel injection nozzles were developed, in which a fuel is injected in two stages, namely, a pilot injection stage and a main injection stage. One such fuel injection nozzle, as disclosed in Japanese Utility Model Publication No. 16041/1995, is provided with a dodge plunger.

The fuel injection nozzle of the above publication will now be described briefly with reference to FIGS. 5 and 6. This fuel injection nozzle has a main body 101 which receives therein a dodge plunger 121, a nozzle spring (not shown), and a needle valve (not shown) downwardly in this order. A plug 106 is attached to an upper end of the main body 101 through a nut 107. The main body 101 includes a nozzle holder 102. A receiving hole 103 is formed in an upper end portion of the nozzle holder 102. A cylinder 116 is received in a lower portion of the receiving hole 103. A threaded member 119 is threaded in an upper portion of the receiving hole 103, thereby securing the cylinder 116. The dodge plunger 121 is slidably received in the cylinder 116.

The first fuel supply passage 130 for allowing the passage of high pressure fuel therethrough is formed in the main body 101. An upper end of the first fuel passage 130 is in communication with a recess 155 which is formed in an upper end face of the nozzle holder 102. A lower end of the first fuel passage 130 is faced with the needle valve. A through-hole 119*a* is formed in the threaded member 119. A recess 141 is defined by an upper surface of the threaded member 119 and an inner peripheral surface of the nozzle holder 102. The second fuel passage 140 is defined by the through-hole 119*a* and the recess 141. The upper end of the first fuel passage 130 and the upper end (i.e., recess 141) of the second fuel passage 140 are in communication with each other through the recess 155.

The third fuel passage 150 is formed in the plug 106. With the plug 106 attached to the main body 101, a lower end of the third fuel passage 150 is in communication with the first and second fuel passages 130 and 140 through the recess 155.

A high pressure fuel is intermittently and cyclically supplied to the fuel injection nozzle from a fuel injection pump which is driven by an engine. This high pressure fuel reaches the needle valve via the third fuel passage 150 of the plug 106 and then via the first fuel passage 130 of the main body 101. Before the supply of the high pressure fuel, the needle valve is caused to sit on a main valve seat to close an injection port and the dodge plunger 121 is sat on a secondary valve seat 120 which is formed on an upper end portion of the cylinder 116, both under the effect of the nozzle spring. When the fuel pressure is raised exceeding an initial valve-opening pressure, the needle valve is lifted against the effect of the nozzle spring. By this, the pilot injection is started. A little later than that, the dodge plunger 121 is lifted. The lifting of the dodge plunger 121 causes the fuel pressure to temporarily drop. When this dropped pressure is propagated to the needle valve, the needle valve is caused to sit on the main valve under the effect of the nozzle spring. In this way, the pilot injection is finished.

It is necessary for the fuel injection nozzle having the above construction to be tested whether or not the pilot injection, which is likely to affect combustion efficiency significantly, is normal before the fuel injection is shipped. Since the pilot injection depends on initial valve-opening pressure and lift starting pressure of the dodge plunger 121, these pressures are measured in the test.

This test procedure will now be described in detail. A fuel pressurizing device is connected to the plug 106 of the fuel injection nozzle. When the fuel pressure supplied from the fuel pressurizing device is raised, this fuel pressure reaches the initial valve opening pressure of the needle valve first and the fuel is then injected. By this, the initial valve opening pressure can be measured. However, the lift starting pressure of the dodge plunger 121 cannot be measured accurately. The reason is that the needle valve is vibrated while it is lifted and therefore, the biasing force of the nozzle spring with respect to the dodge plunger is varied. Accordingly, for measuring the lift starting pressure of the dodge plunger, the first fuel passage is shut off by turning a spacer 180 degrees, which spacer is interposed between the nozzle holder and a nozzle body which receives the needle valve. In that state, the lift starting pressure of the dodge plunger 121 can be measured accurately. However, it is required that after the test is finished, the spacer is returned to its original position and the spacer and the nozzle body are attached to the nozzle holder again. This invites deterioration of workability of the test.

Incidentally, recently, a fuel injection nozzle capable of reducing the quantity of pilot injection was developed. In this fuel injection nozzle, the initial valve opening pressure of the needle valve is higher than the lift starting pressure of the dodge plunger. This makes it possible to measure the lift starting pressure of the dodge plunger in the state of a final product. However, the initial valve opening pressure of the needle valve is practically impossible to be measured accurately because it is adversely affected by the lifting of the dodge plunger. For this reason, when the initial valve opening pressure of the needle valve is measured, a blind testing threaded member is used instead of the regular threaded member 119 having the through-hole 119*a*, thereby shutting off the second fuel passage 140. In this state, the initial valve opening pressure of the needle valve can be measured accurately. However, this inevitably necessitates such a series of troublesome work as removing the testing threaded member, attaching the regular threaded member 119 and then attaching the regular plug 106, all after completion of the test. Moreover, it sometimes happened attributable to difference in strength for tightening the testing threaded member and for tightening the regular threaded member 119 that the force of the nozzle spring is slightly varied and therefore, an expected pilot injection cannot be realized.

Where the initial valve opening pressure of the needle valve and the lift starting pressure of the dodge plunger are equal or negligibly small in difference, it is required that the second fuel passage 140 is shut off to measure the initial valve opening pressure of the needle valve and the first fuel passage 130 is shut off to measure the lift starting pressure of the dodge plunger 121. Thus, those two measurements are encountered with the above-mentioned inconveniences.

SUMMARY OF THE INVENTION

It is, therefore, an object of the present invention to provide a fuel injection nozzle capable of efficiently carrying out testing of pilot injection, and a method for testing this fuel injection nozzle.

According to the present invention, there is provided a fuel injection nozzle comprising:

(a) an elongated hollow main body, the main body having a first, a second and a third receiving hole arranged forwardly in this order, the main body including a main valve seat and an injection port formed at a distal end thereof, the injection port being in communication with the third receiving hole through the main valve seat, the main body including a secondary valve seat formed on an area in the vicinity of a basal end thereof, the main body further including a first and a second fuel passage for allowing passage of high pressure fuel therethrough, a distal end of the first fuel passage being in communication with the third receiving hole and a basal end thereof being open to a basal end face of the main body, a distal end of the second fuel passage being in communication with the first receiving hole through the secondary valve seat and a basal end thereof being open to the basal end face of the main body, the basal ends of the first and second fuel passages being away from and independent of each other on the basal end face of the main body;

(b) a needle valve received in the third receiving hole of the main body, the needle valve being capable of sliding axially of the main body, the needle valve being also capable of sitting on and lifting from the main valve seat;

(c) a dodge plunger received in the first receiving hole of the main body, the dodge plunger being capable of sliding axially of the main body, the dodge plunger being capable of sitting on and lifting from the secondary valve seat;

(d) a nozzle spring received in the second receiving hole of the main body, the nozzle spring biasing the needle valve and the dodge plunger in directions away from each other, thereby biasing the needle valve and the dodge plunger towards the main valve seat and the secondary valve seat, respectively; and (e) a plug attached to a basal end of the main body, the plug including a third fuel passage for allowing passage of high pressure fuel therethrough, a distal end of the third fuel passage being in communication with the basal ends of the first and second fuel passages, the basal ends of the first and second fuel passage being in communication with each other only through the distal end of the third fuel passage.

From another aspect of the invention, there is also provided a method for testing a fuel injection nozzle comprising the steps of:

(a) preparing a fuel injection nozzle, the fuel injection nozzle including:

(i) an elongated hollow main body, the main body having a first, a second and a third receiving hole arranged forwardly in this order, the main body including a main valve seat and an injection port formed at a distal end thereof, the injection port being in communication with the third receiving hole through the main valve seat, the main body including a secondary valve seat formed on an area in the vicinity of a basal end thereof, the main body further including a first and a second fuel passage for allowing passage of high pressure fuel therethrough, a distal end of the first fuel passage being in communication with the third receiving hole and a basal end thereof being open to a basal end face of the main body, a distal end of the second fuel passage being in communication with the first receiving hole through the secondary valve seat and a basal end thereof being open to the basal end face of the main body, the basal ends of the first and second fuel passages being away from and independent of each other on the basal end face of the main body;

(ii) a needle valve received in the third receiving hole of the main body, the needle valve being capable of sliding axially of the main body, the needle valve being also capable of sitting on and lifting from the main valve seat;

(iii) a dodge plunger received in the first receiving hole of the main body, the dodge plunger being capable of sliding axially of the main body, the dodge plunger being capable of sitting on and lifting from the secondary valve seat;

(iv) a nozzle spring received in the second receiving hole of the main body, the nozzle spring biasing the needle valve and the dodge plunger in directions away from each other, thereby biasing the needle valve and the dodge plunger towards the main valve seat and the secondary valve seat, respectively; and (v) a testing plug attached to a basal end of the main body, the testing plug including a third fuel passage for allowing passage of high pressure fuel therethrough, a distal end of the third fuel passage being open to a distal end face of the plug and in communication only with the basal end of the first fuel passage, the distal end of the third fuel passage being shut off communication from the basal end of the second fuel passage;

(b) connecting a fuel pressurizing device to a basal end of the third fuel passage of the testing plug for testing the fuel injection nozzle, the fuel pressurizing device gradually raising pressure of the supplied fuel, pressure for starting the lifting of the needle valve being measured during a process of gradual increase of the fuel pressure, the testing plug being removed from the main body after the testing; and (c) attaching a regular plug to the main body and shipping the fuel injection nozzle in that state, the regular plug including a fourth fuel passage for allowing passage of high pressure fuel, a distal end of the fourth fuel passage being in communication with the basal ends of the first and second fuel passages, the basal ends of the first and second fuel passages being in communication with each other only through the distal end of the fourth fuel passage.

DETAILED DESCRIPTION OF THE EMBODIMENT

Figure 1:
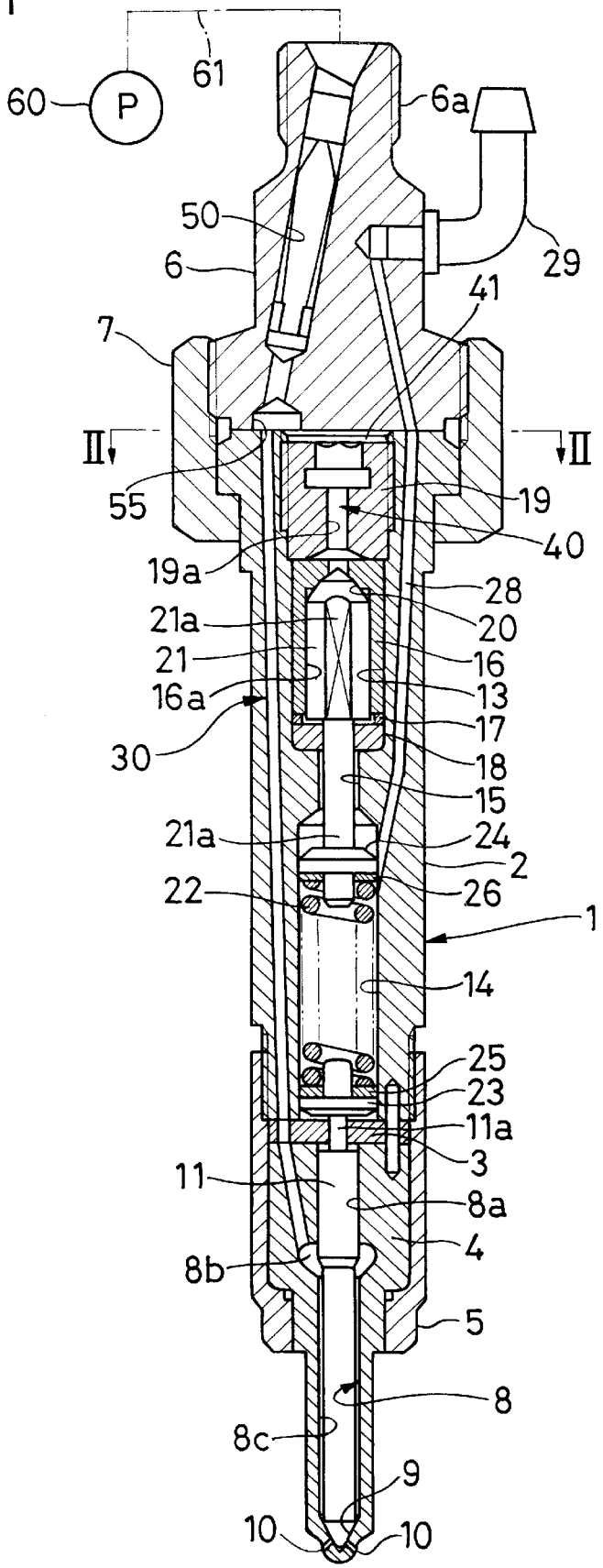
FIG. 1 is a vertical sectional view showing a fuel injection nozzle according to one embodiment of the present invention.

A fuel injection nozzle according to one embodiment of the present invention will now be described with reference to FIGS. 1 and 2. This fuel injection nozzle is attached to an engine (not shown) such that it faces a combustion chamber of the engine. The fuel injection nozzle, in operation, receives cyclically and intermittently the supply of high pressure fuel from a fuel injection pump 60 which is driven by the engine.

A construction of the fuel injection nozzle will now be described in detail. The fuel injection nozzle includes an elongated hollow main body 1. This main body 1 includes a nozzle holder 2, a spacer 3, and a nozzle body 4 all arranged in this order downwardly. The nozzle body 4 is connected to the nozzle holder 3 by a nut 5.

The plug 6 is connected to an upper end of the nozzle holder 2 by a nut 7. A threaded portion 6*a* is formed in an outer periphery of an upper end of the plug 6, so that one end of a fuel tube 61 can be connected thereto. The other end of the fuel tube 61 is connected to the fuel injection pump 60.

A receiving hole 8 (third receiving hole) is formed in the nozzle body 4 and extends axially of the nozzle body 4. The receiving hole 8 has a guide portion 8*a*, a fuel pool portion 8*b*, and a flow portion 8*c* all arranged in this order downwardly. A main valve seat 9 and an injection port 10 are formed at a distal end of the nozzle body 4. This injection port 10 is communicated with the receiving hole 8 through the main valve seat 9.

A needle valve 11 is received in the receiving hole 8. An upper end portion of the needle valve 11 is enlarged in diameter. This enlarged upper end portion is axially slidably received in the guide portion 8*a*. A lower end of the needle valve 11 is of a conical shape. This conical lower end is faced with the main valve seat 9. When the needle valve 11 is caused to sit on the main valve seat 9, the injection port 10 is closed, and when the needle valve 11 is lifted from the main valve seat 9, the injection port 10 is opened. A full-lift position of the needle valve 11 is determined by the needle valve 11 contacting the spacer 3.

A receiving hole 13 is formed in an upper portion of the nozzle holder 2 and allowed to extend in an axial direction of the nozzle holder. Another receiving hole 14 (second receiving hole) is formed in a lower portion of the nozzle holder 2 and allowed to extend likewise in the axial direction. The receiving holes 13 and 14 are communicated with each other through a through-hole 15 having a reduced diameter. A cylinder 16, a ring-shaped shim 17, and a ring-shaped stopper 18 are received in the receiving hole 13 and arranged in this order downwardly. The cylinder 16, the shim 17, and the stopper 18 are fixed by a threaded member 19 which is threaded in an upper portion of the receiving hole 13. The cylinder 16 and the threaded member 19 constitute a part of the main body 1.

A secondary valve seat 20 is formed on an upper end portion of the cylinder 16. A dodge plunger 21 is received in an internal space 16*a* (first receiving hole) of the cylinder 16. This dodge plunger 21 is axially slidable so that it can sit on and lift from the secondary valve seat 20. The fully-lifted position of the dodge plunger 21 is determined at the time the dodge plunger 21 is brought into contact with the stopper 18 which is disposed at a bottom portion of the receiving hole 13. A beveling 21*a* is formed on the dodge plunger 21. A leak passage having a small sectional area is formed between the beveling 21*a* and an inner peripheral surface of the cylinder 16.

A compressed nozzle spring 22 is received in the receiving hole 14 of the nozzle holder 2. The needle valve 11 and the dodger plunger 21 are biased in a direction away from each other by the nozzle spring 22. Specifically, a rod portion 11*a* having a reduced diameter extends axially upwardly from an upper end of the needle valve 11. The rod portion 11*a* passes through the stopper 4 and extends axially upwardly from an upper end of the needle valve 11. A spring retainer 23 is in contact with an upper end of the rod portion 11*a* at a lower part of the receiving hole 14. A rod portion 21*b* extends axially downwardly from a lower end of the dodge plunger 21. This rod portion 21*b* passes through the shim 17 and the stopper 18 and also passes through the through-hole 15 of the nozzle holder 2. A spring retainer 24 is in contact with a lower end of the rod portion 21*b* at an upper part of the receiving hole 14. An upper and a lower end of the nozzle spring 22 are received respectively by the spring retainers 23 and 24, respectively through the shims 25 and 26. Owing to this arrangement, the nozzle spring 22 biases the needle valve 11 downwardly towards the main valve seat 9 and also biases the dodge plunger 21 upwardly towards the secondary valve seat 20.

The main body 1 has a drain passage 28 extending from the nozzle holder 2 to the plug 6. One end of the drain passage 28 is communicated with the upper part of the receiving hole 14, and the other end thereof is open to an outer peripheral surface of the plug 6 and connected to a drain pipe (not shown) through a joint 29.

The pressure receiving areas of the needle valve 11 and dodge plunger 21 for receiving the fuel pressure will now be described. If the pressure receiving areas of the needle valve 11 and dodge plunger 21 are represented respectively by $S_{N1}$, $S_{N2}$, and $S_{D1}$, $S_{D2}$ when the needle valve 11 and dodge plunger 21 are sitting and lifting, the following expression is established.

$$S_{N1}<S_{D1}<S_{N2}<S_{D2} \quad (1)$$

It should be noted that $S_{D1}$ is merely slightly larger than $S_{N1}$.

The pressure receiving area $S_{N1}$ of the needle valve 11 when the needle valve 11 is sitting, can be obtained by subtracting an area surrounded by a circular abutting line between the needle valve 11 and the main valve seat 9 from the sectional area of the upper end portion of the needle valve 11. The pressure receiving area $S_{N2}$ when the needle valve 11 is lifting, is equal to the sectional area of the upper end portion of the needle valve 11.

The pressure receiving area $S_{D1}$ when the dodge plunger 21 is sitting is equal to an area surrounded by a circular abutting line between the dodge plunger 21 and the secondary valve seat 20. The pressure receiving area $S_{D2}$ when the dodge plunger 21 is lifting, is equal to a sectional area in the dodge plunger 21 inserted into the internal space 16*a* of the cylinder 16.

Fuel passages as a characteristic part of the present invention will now be described in detail. The main body 1 has a first fuel passage 30 extending through the nozzle holder 2, the spacer 3 and the nozzle body 4. An upper end of this fuel passage 30 is open to an upper end face of the nozzle holder 2, whereas a lower end thereof is in communication with a fuel pool portion 8*b* of the receiving hole 8.

An axially-extending through-hole 19*a* is formed in the threaded member 19. A lower end of the through-hole 19*a* is in communication with the secondary valve seat 20. An upper end face of the threaded member 19 is lower than that of the nozzle holder 2. Owing to this feature, a recess 41 is defined by an inner peripheral surface of the upper end portion of the nozzle holder 2 and the upper end face of the threaded portion 19. This recess 41 and the through-hole 19*a* of the threaded member 19 constitute a second fuel passage 40 for allowing passage of the high pressure fuel.

Figure 2:
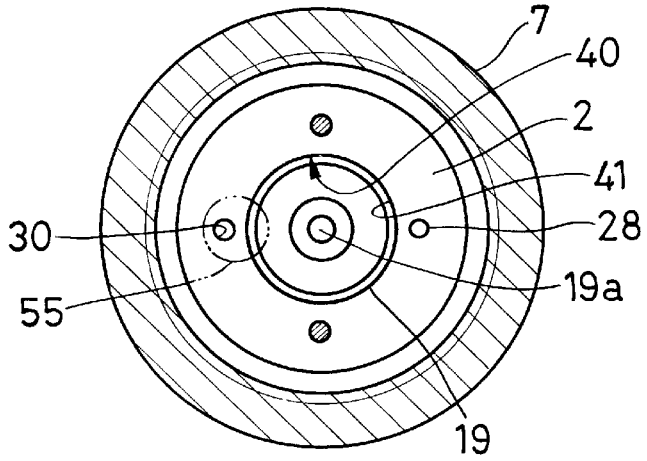
FIG. 2 is a cross-sectional view taken on line II—II of FIG. 1.

Attention should be brought here to the fact that the upper end of the first fuel passage 30 and the upper end (i.e., recess 41) of the second fuel passage 40 are away from and independent of each other on the upper end face of the nozzle holder 2, as shown in FIGS. 1 and 2.

The plug 6 includes a third fuel passage 50 for allowing passage of the high pressure fuel. An upper end of the third fuel passage 50 is open to the upper end face of the plug 6 and in communication with the fuel tube 61. A circular recess 55 is formed in the lower end face of the plug 6. This recess 55 is provided as the lower end of the third fuel passage 50. The recess 55 occupies an area including parts opposing the upper ends of said first and second fuel passages 30 and 40 and is in communication with the upper ends of the first and second fuel passages 30 and 40. The upper ends of the first and second fuel passages 30 and 40 are in communication with each other only through the recess 55.

Operation of the fuel injection nozzle thus constructed will now be described. Before the fuel is supplied under pressure from the fuel injection pump 60 to the fuel injection nozzle, the needle valve 11 is caused to sit on the main valve seat 9 and the dodge plunger 21, on the secondary valve 20 under the effect of the nozzle spring 22. When the pressure of the supplied fuel exceeds the predetermined initial valve-opening pressure $P_{N1}$, the needle valve 11 is lifted from the main valve seat 9 and the high pressure fuel is injected from the injection port 10. That is, the pilot injection is started. Here, the initial valve-opening pressure $P_{N1}$ is expressed by the following relation.

$$P_{N1}=F_1/S_{N1} \quad (2)$$

where $F_1$ represents a force of the nozzle spring 22 exerted to the needle valve 11 when both the needle valve 11 and the dodge plunger 21 are sitting.

As previously mentioned, since $S_{D1}$ is slightly larger than $S_{N1}$, the dodge plunger 21 is lifted earlier than that of the conventional fuel injection nozzle. When the dodge plunger 21 starts lifting, the pressure receiving area of the dodge plunger is abruptly increased from $S_{D1}$ to $S_{D2}$. For this reason, the dodge plunger 21 is rushed downwardly to contact the stopper 23 where it reaches the fully lifted position.

The lifting of the dodge plunger 21 causes a temporary drop of the fuel pressure. A pressure wave generated due to this pressure drop is propagated to the needle valve 11 via the second fuel passage 40 and the first fuel passage 30. This causes a temporary drop of the fuel pressure given to the needle valve 11. As a consequence, the needle valve 11 is caused to sit under the effect of the nozzle spring 22, and the pilot injection is finished. The time period for the pilot injection can be shorter than that of the conventional fuel injection nozzle, and the quantity of pilot injection can be reduced.

As mentioned above, since the dodge plunger 21 is lifted and the nozzle spring 22 is compressed to that extent, the biasing force of the nozzle spring 22 to the needle valve 11 is increased compared with the biasing force before the pilot injection. As a consequence, the needle valve 11 is held in its sitting state until the time for main injection as later described.

When the fuel pressure is further increased and exceeds a main valve opening pressure $P_M$, the needle valve 11 is lifted from the main valve seat 9 and the main injection is started. Here, the main valve opening pressure $P_M$ can be expressed by the following equation.

$$P_M=F_2/S_{N1} \quad (3)$$

where $F_2$ represents a force of the nozzle spring 22 exerted to the needle valve 11 when the needle valve 11 is sitting and the dodge plunger 21 is in its fully lifted position.

When one supplying operation of the high pressure fuel is finished after the lifting of the needle valve 11, the fuel pressure is lowered. As a consequence, the needle valve 11 is caused to sit on the main valve seat 9 under the biasing force of the nozzle spring 22. As a consequence, the main injection is finished. After the needle valve 11 is caused to sit, the dodge plunger 35 is biased upwardly by the nozzle spring 22 and caused to sit on the secondary valve seat 20.

The fuel injection nozzle thus constructed is a final product. This fuel injection nozzle is subjected to the following two-stage testing before shipment.

Figure 3:
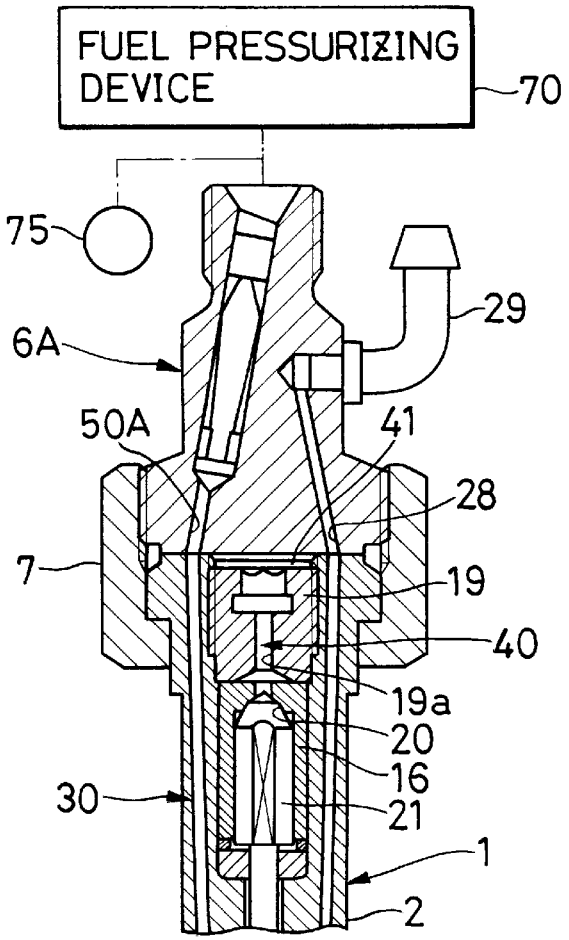
FIG. 3 is a vertical sectional view showing a main portion of the fuel injection nozzle when an initial valve opening pressure of a needle valve is measured, a testing plug being used at that time.

The first stage testing is intended for measuring an initial valve-opening pressure of the needle valve 11. Specifically, a testing plug 6A of FIG. 3 is used in this test, instead of the above-mentioned regular plug 6. With the plug 6A attached to the main body 2, the plug 6A is connected to a fuel pressurizing device 70. There is a provision of a pressure gage 75 located on a fuel path between the plug 6A and the fuel pressurizing device 70.

The plug 6A includes a fuel passage 50A. A lower end of this fuel passage 50A is open to a lower end face of the plug 6A and in communication only with the upper end of the first fuel passage 30. A communication between the lower end of the fuel passage 50A and the upper end of the second fuel passage 40 is shut off.

When the pressure of the supplied fuel from the fuel pressurizing device 70 is gradually raised, it reaches the initial valve opening pressure of the needle valve 11 (FIG. 1) to cause the needle valve 11 to lift. At that time, the pressure measured by the pressure gage 75 is temporarily dropped. The pressure detected immediately before this pressure drop is recognized as the initial valve opening pressure. Because the second fuel passage 40 is closed, the dodge plunger 21 is not lifted. For this reason, the initial valve opening pressure of the needle valve can accurately be measured without being adversely affected by the lifting of the dodge plunger 21. When the measured initial valve opening pressure is different from a desired value, one of the shims 25 and 26 is selectively replaced by a different shim to adjust the force of the nozzle spring 22. After the completion of this test, the plug 6A is removed.

Figure 4:
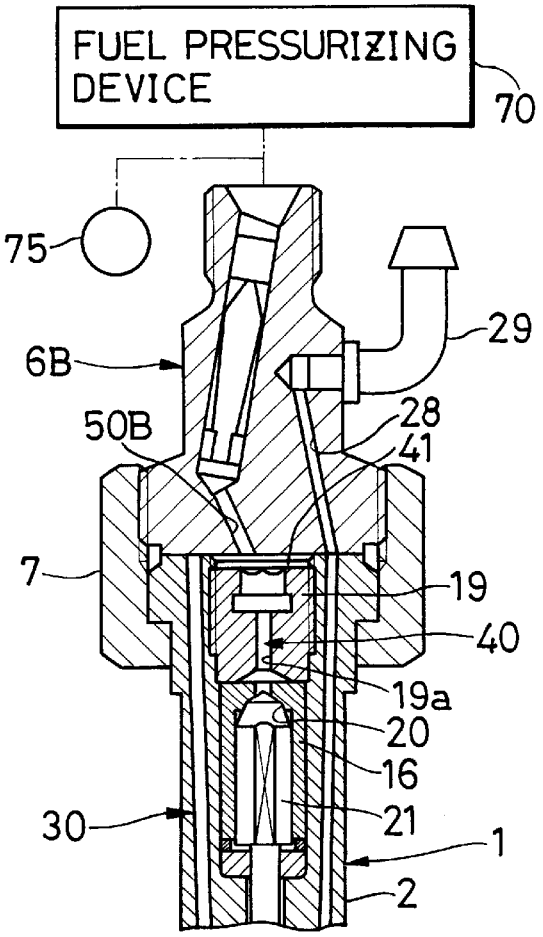
FIG. 4 is a vertical sectional view showing the main portion of the fuel injection nozzle when a lift starting pressure of a dodge plunger is measured, another testing plug being used at that time.
Figure 5:
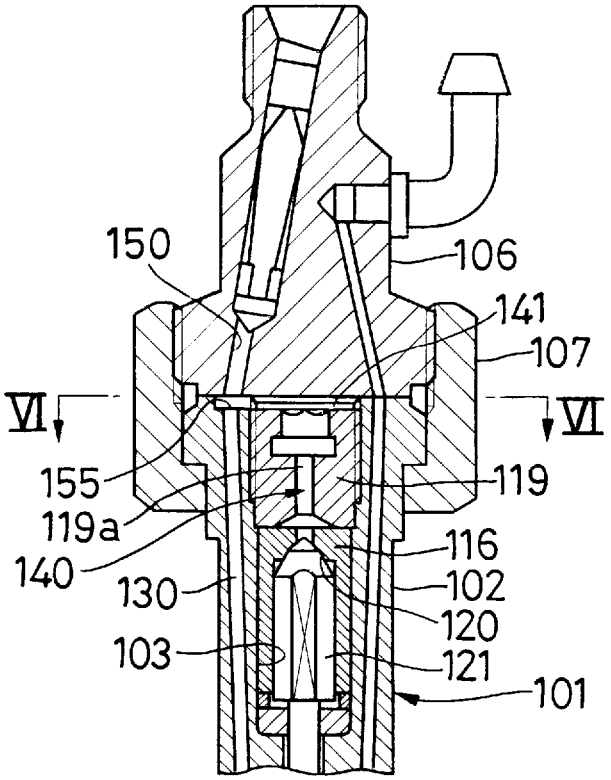
Fig.5 (PRIOR ART)
FIG. 5 is a vertical sectional view showing a main portion of a conventional fuel injection nozzle.
Figure 6:
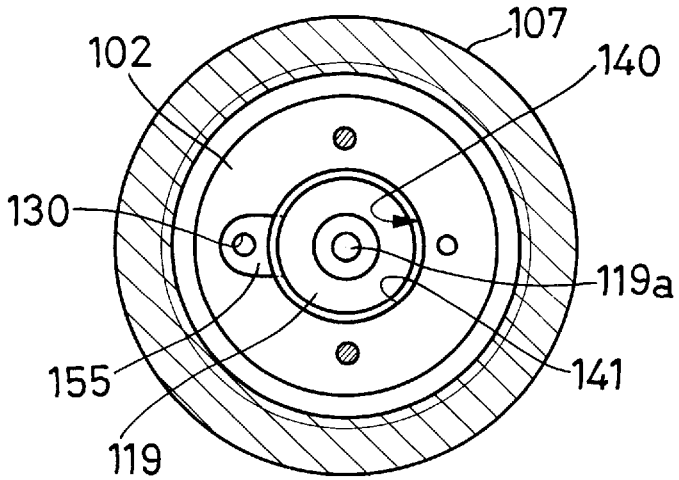
Fig.6 (PRIOR ART)
FIG. 6 is a sectional view taken on line VI—VI of FIG. 5.

The second-stage testing will be described in detail next. This test is intended for measuring the lift starting pressure of the plunger 21. A testing plug 6B of FIG. 4 is used in this test. With the plug 6B attached to the main body 2, the plug 6B is connected to the fuel pressurizing device 70 as in the first-stage testing.

A lower end of a fuel passage 50B of the plug 6B is open to a lower end face of the plug 6B and in communication only with the upper end, i.e., recess 41, of the second fuel passage 40. A communication between the lower end of the fuel passage 50B and the upper end of the first fuel passage 30 is shut off.

When the pressure of the supplied fuel from the fuel pressurizing device 70 is gradually raised, it reaches the lift starting pressure of the dodge plunger 21 to cause the dodge plunger 21 to lift. At that time, the pressure measured by the pressure gage 75 is temporarily dropped. The pressure detected immediately before this pressure drop is recognized as the lift starting pressure. Because the first fuel passage 40 is closed, the lift starting pressure of the dodge plunger 21 can accurately be measured without being adversely affected by the lifting of the needle valve 11. When the measured lift starting pressure is different from a desired value, the cylinder 16 is replaced by a new one to vary the pressure receiving area when the dodge plunger 21 is sitting.

After the completion of this second-stage testing, the testing plug 6B is removed from the main body 1 and the regular plug 6 (FIG. 1) is attached thereto.

As mentioned above, where the measured values of the initial valve opening pressure of the needle valve 11 and the lift starting pressure of the dodge plunger 21 are the desired values, it suffices that the plugs 6A, 6B and 6 are simply replaced during the time period from the start of the testing to the shipment. Accordingly, workability is good. Moreover, the replacement of the plugs 6A, 6B and 6 does not change the characteristics of the pilot injection, and the final product can exhibit the desired characteristics of pilot injection.

It is true that the initial valve opening pressure of the needle valve 11 and the lift starting pressure of the dodge plunger 21 which are measured in a static condition are different from the initial valve opening pressure of the needle valve 11 and the lift starting pressure of the dodge plunger 21 which are measured in a dynamic condition at the fuel injection nozzle as the final product. However, since a correlation therebetween can preliminarily be obtained through experiment, there is no problem.

The present invention is not limited to the above embodiment and many changes can be made. For example, the pressure receiving area when the needle valve is sitting may be equal to or larger than the pressure receiving area when the dodge plunger is sitting.

What is claimed is:

1. A fuel injection nozzle comprising:

an elongated nozzle holder having a first axial bore and a spring chamber therein and a first valve seat formed upstream of the first axial bore, the first valve seat having an end terminating in an orifice;

a nozzle body connected to a distal end of the nozzle holder, the nozzle body having a second axial bore therein and a second valve seat formed downstream of the second axial bore, the second valve seat having an end terminating in an injection port;

a first fuel passage having a first inlet end open at a basal end face of the nozzle holder and a first outlet end open to a fuel pool chamber upstream of the second axial bore;

a second fuel passage having a second inlet end open to the basal end face of the nozzle holder and a second outlet end open to the orifice upstream of the first valve seat, the second inlet end being isolated from the first inlet end to permit fuel to be independently supplied to the first and second fuel passages;

a plug removably attached to the nozzle holder, the plug having a distal end face mating with the basal end face of the nozzle holder and a third fuel passage for selectively communicating pressurized fuel to the first and second inlet ends of the first and second fuel passages, respectively;

a dodge plunger slidably movable in the first axial bore, the dodge plunger being configured to lift off the first valve seat to open the orifice or sit on the first valve seat to close the orifice;

a needle valve slidably movable in the second axial bore, the needle valve being configured to lift off the second valve seat to open the injection port or sit on the second valve seat to close the injection port; and a spring assembly disposed in the spring chamber for biasing the dodge plunger and the needle valve towards the first valve seat and the second valve seat, respectively.

2. A fuel injection nozzle according to claim 1, wherein the third fuel passage includes a recess formed at the end face of the plug, the recess overlapping the first and second inlet ends of the first and second fuel passages.

3. A method for testing a fuel injection nozzle having a needle valve and a dodge plunger slidably movable inside a main body and a first and a second fuel passage for communicating fuel to the needle valve and the dodge plunger, respectively, comprising the steps of:

attaching a first testing plug having a fuel passage with an outlet end communicable with only an inlet end of the first fuel passage to a basal end of the main body;

supplying fuel to the first fuel passage through the fuel passage in the first testing plug;

connecting a fuel pressurizing device to an inlet end of the fuel passage in the first testing plug;

operating the fuel pressurizing device to gradually raise the pressure of the fuel supplied to the first fuel passage until the needle valve in the main body starts to lift off a needle valve seat in the main body;

measuring the pressure at which the needle valve starts to lift off the needle valve seat; and detaching the first testing plug from the main body.

4. The method of claim 3, further comprising the steps of:

attaching a second testing plug having a fuel passage with an outlet end communicable with only an inlet end of the second fuel passage to the basal end of the main body;

supplying fuel to the second fuel passage in the main body through the fuel passage in the second testing plug;

connecting the fuel pressurizing device to an inlet end of the fuel passage in the second testing plug;

operating the fuel pressurizing device to gradually raise the pressure of the fuel supplied to the second fuel passage until the dodge plunger starts to lift off a plunger seat in the main body;

measuring the pressure at which the dodge plunger starts to lift off the plunger seat; and detaching the second testing plug from the main body.

5. The method of claim 4, further including the step of attaching a regular plug having a fuel passage with an outlet end communicable with both the inlet ends of the first and second fuel passages to the basal end of the main body.

* * * * *